US006328599B1

(12) United States Patent
Marshall et al.

(10) Patent No.: US 6,328,599 B1
(45) Date of Patent: Dec. 11, 2001

(54) ELECTRICAL CONNECTOR HAVING MOUNTING POSTS ADAPTED TO BE RECEIVED BY A PRINTED WIRING BOARD

(75) Inventors: Robert E. Marshall, Elizabethtown; Gregory A. Hull, York, both of PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/213,141

(22) Filed: Dec. 18, 1998

(51) Int. Cl.[7] ..... H01R 13/66
(52) U.S. Cl. ..... 439/567
(58) Field of Search ..... 439/567, 79, 557, 439/82, 83, 571, 676; 411/456, 300, 304, 342, 347, 607, 609

(56) References Cited

U.S. PATENT DOCUMENTS

| | | | | |
|---|---|---|---|---|
| 3,487,350 | * | 12/1969 | Hammel | 439/567 |
| 4,195,900 | * | 4/1980 | Hughes | 439/567 |
| 4,655,517 | * | 4/1987 | Bryce | 439/567 |
| 4,728,238 | * | 3/1988 | Chisholm et al. | 439/567 |
| 4,907,987 | * | 3/1990 | Douty et al. | 439/567 |
| 5,115,375 | * | 5/1992 | Garay | 439/567 |
| 5,120,257 | * | 6/1992 | Halm | 439/567 |
| 5,244,412 | | 9/1993 | Hatch et al. | 439/567 |
| 5,378,172 | | 1/1995 | Roberts | 439/607 |
| 5,409,399 | * | 4/1995 | Georhegan et al. | 439/567 |
| 5,441,423 | | 8/1995 | Champion et al. | 439/467 |
| 5,613,877 | | 3/1997 | Patel et al. | 439/567 |
| 5,981,877 | * | 11/1999 | Sakata et al. | 439/567 |
| 5,984,722 | * | 11/1999 | Ito | 439/457 |

FOREIGN PATENT DOCUMENTS

| | | |
|---|---|---|
| 0 801 446 A1 | 3/1997 | (EP) . |
| 04349374 | 12/1992 | (JP) . |

* cited by examiner

*Primary Examiner*—Neil Abrams
*Assistant Examiner*—J. F. Duverne
(74) *Attorney, Agent, or Firm*—Woodcock Washburn Kurtz Mackiewicz & Norris LLP

(57) ABSTRACT

An electrical connector (10) that may be surface mounted to a circuit board that includes a housing (11) having an outer shielding (40) and mounting posts (32) formed at a base of the connector. The outer shielding surrounds the housing and includes two "T-shaped" extensions (44) that are formed at a bottom of the shielding. The "T-shaped" extensions (44) are bent at approximately a 90° angle with respect to the lateral walls (16, 18) of the housing and through an opening in the mounting posts (32) such that the top of "T" is retained within a groove that is formed in the bottom of each mounting post. The top of the "T" has length that is longer than the diameter of the mounting post (32) such that the ends of the "T" extend beyond the periphery of the mounting post (32), and are longer than the diameter of a receiving hole of a printed wiring board (52) into which the mounting post is inserted. When the connector (10) is mounted to a printed wiring board (52), the mounting posts are inserted into their respective receiving holes and the ends of the "T" that extend beyond the periphery of the mounting posts (32) are deflected upwardly in a direction opposite of the direction of insertion to retain the connector on the printed wiring board (52).

20 Claims, 5 Drawing Sheets

ELECTRICAL CONNECTOR HAVING MOUNTING POSTS ADAPTED TO BE RECEIVED BY A PRINTED WIRING BOARD

FIELD OF THE INVENTION

The present invention is related to electrical connectors. More particularly, the present invention is related to a device for positioning and securing an electrical connector to a printed wiring board.

BACKGROUND OF THE INVENTION

The present invention relates generally to improvements in electrical devices intended for surface mounting on printed wiring boards and in the mounting components thereof. Conventional mounting posts typically include hooked ends that are used to snap an electrical device into place on a printed wiring board. However, such mounting posts have many deficiencies. For example, when the hooked ends of the mounting posts of a board-mounted device snaps into engagement with the underside of the board, the impact may cause other components to be jarred loose. Further conventional mounting components typically include separate elements for locating the electrical device and for retaining the device to the printed wiring board.

An improvement over the hooked-end mounting post is described in U.S. Pat. No. 5,244,412, to Hatch et al., entitled "Electrical Device for Surface Mounting on a Circuit Board and Mounting Component Thereof." The Hatch et al. mounting device includes a pair of positioning posts and a molded mounting post. The position posts cooperate with corresponding openings in a printed wiring board to position the connector with respect to the board. The separately provided mounting post includes a clip that forms tangs that extend beyond the sides of the post. When the connector employing the Hatch et al. mounting device is mounted to a printed wiring board, the tangs deflected within a receiving hole in the board to retain the connector on the board.

While the Hatch et al. device is an improvement over other conventional mounting posts that mechanically connect devices to printed circuit boards, the Hatch et al. still presents problems in surface mount applications. The Hatch et al. device fails to address problems encountered when mounting electrical connectors to printed wiring boards that have components mounted to both sides of the board as the Hatch et al. mounting device protrudes through the board. Further, the Hatch et al. device does not provide for a reduced-sized connector as separate positioning and mounting posts are required to retain the connector on the board. It would, therefore, be desirable to reduce the space required by the retaining mechanism of an electrical connector. It is also desirable to have a retaining mechanism that reduces the likelihood of interference with other components mounted to the printed wiring board. The present invention provides such a solution.

SUMMARY OF THE INVENTION

An electrical connector that may be surface mounted to a circuit board that includes an insulative housing, an outer shielding, and mounting posts formed at abase of the insulative housing. The mounting posts define a groove that is formed in the bottom of each mounting post and a generally "U-shaped" opening in the wall of the mounting posts that faces outward of the connector. The outer shielding surrounds the insulative housing and includes two "T-shaped" extensions that are formed at a bottom of the shielding.

The"T-shaped" extensions are bent at approximately a 90° angle with respect to the lateral walls of the housing and through the opening in the mounting posts such that the top of "T" is retained within the groove that is formed in the bottom of each mounting post.

The top of the "T" has length that is longer than the diameter of the mounting post such that the ends of the "T" extend beyond the periphery of the mounting post, and are longer than the diameter of a receiving hole of a printed wiring board into which the mounting post is inserted. When the connector is mounted to a printed wiring board, the mounting posts are inserted into their respective receiving holes and the ends of the "T" that extend beyond the periphery of the mounting posts are deflected upwardly in a direction opposite of the direction of insertion to retain the connector on the printed wiring board.

In a further feature, the length of the mounting post is less than the width of the printed circuit board to which the connector is mounted. This feature advantageously provides for a connector that may be mounted to one side of the board without interfering with components mounted on the other side of the board.

Other features will be described herein.

DETAILED DESCRIPTION OF THE PREFERRED EMBODIMENTS

Figure 1:
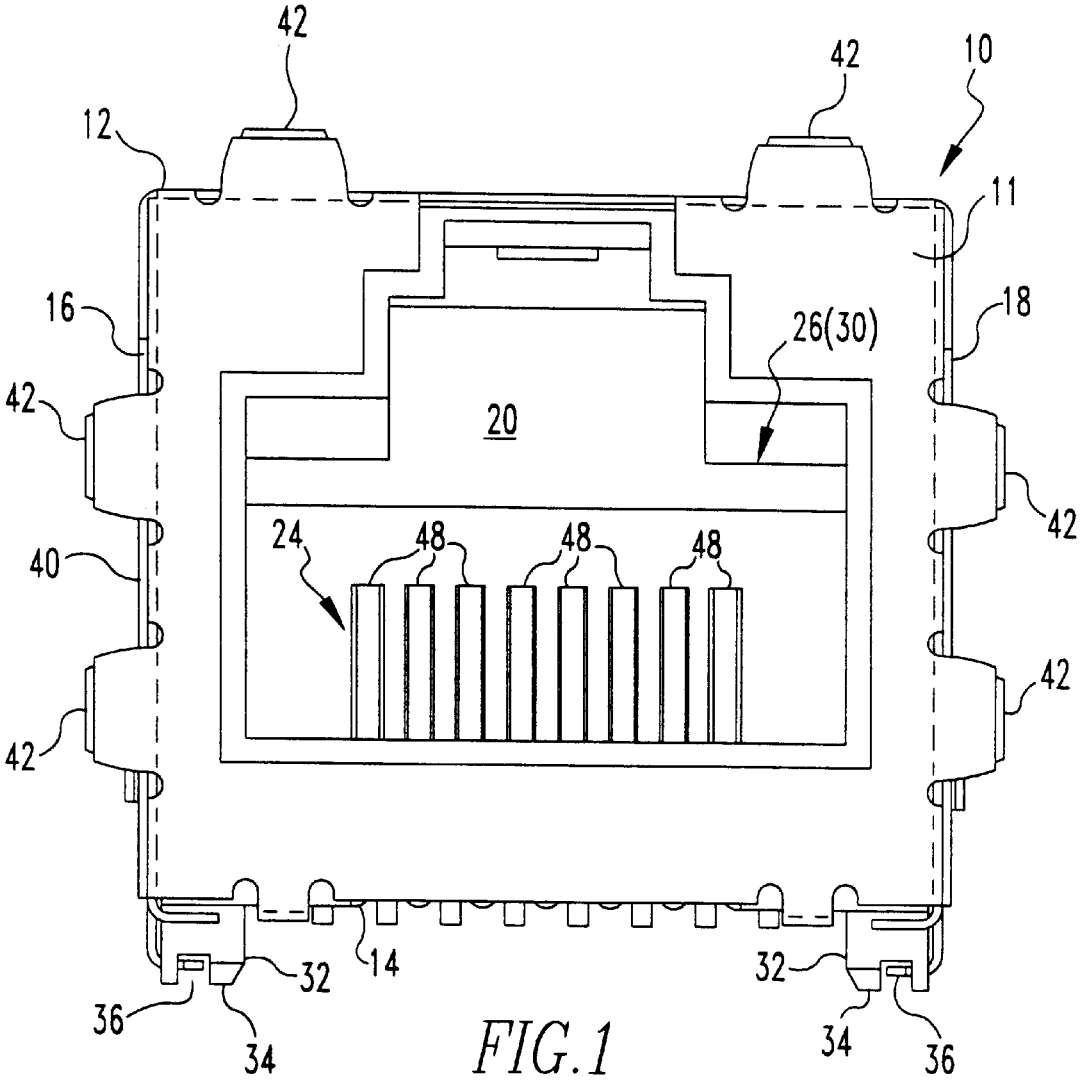
FIG. 1 is an elevational view of a front of an electrical connector of the present invention.

The present invention has applicability to connectors that are surface mounted to a printed wiring board. Referring to FIGS. 1–4, there is illustrated a modular jack connector (electrical connector) 10 having a housing 11 comprising a top wall 12, a bottom wall 14, a pair of opposed lateral walls 16 and 18, and a rear wall 19. The housing 11 is constructed of a thermoplastic polymer having suitable insulative properties. Within these walls is an interior section 20, which has a forward open end 24. Projecting upwardly from the bottom wall 14 in this interior section 20 there is a medial wall generally shown at numeral 26 which has a rear side 28 and a front side shown generally at numeral 30. Formed on the bottom wall 14 are generally cylindrical mounting posts 32 having ends 34. Each mounting post 32, at each end 34, defines a groove 36 that runs across a diameter of the mounting post 32. A generally "U-shaped" opening 38 is also formed in the cylindrical wall of the mounting post 32 and faces outwardly of the connector 10. As will be explained later, the mounting posts 32 are provided as part of an improved device to both locate and secure the electrical connector 10 to a printed wiring board 52 (see, FIGS. 5A–5C).

Within the housing 11 is disposed a plurality of conductive leads 48, which are adapted to mate with complementary leads of a plug (not shown). The conductive leads 48 extend into the interior section 20 and run downward to the medial wall 26 and along the bottom of the electrical conductor 10. The conductive leads extend outward of the rear of the electrical conductor 10 to form pad-engaging contact portions 50. As the electrical connector 10 is mounted to the printed wiring board, the contact portions 50 touch a solder paste composition on contact pads on the printed wiring board. Later, the contact portions 50 may be permanently soldered to the board using conventional means (e.g., reflow).

Figure 2:
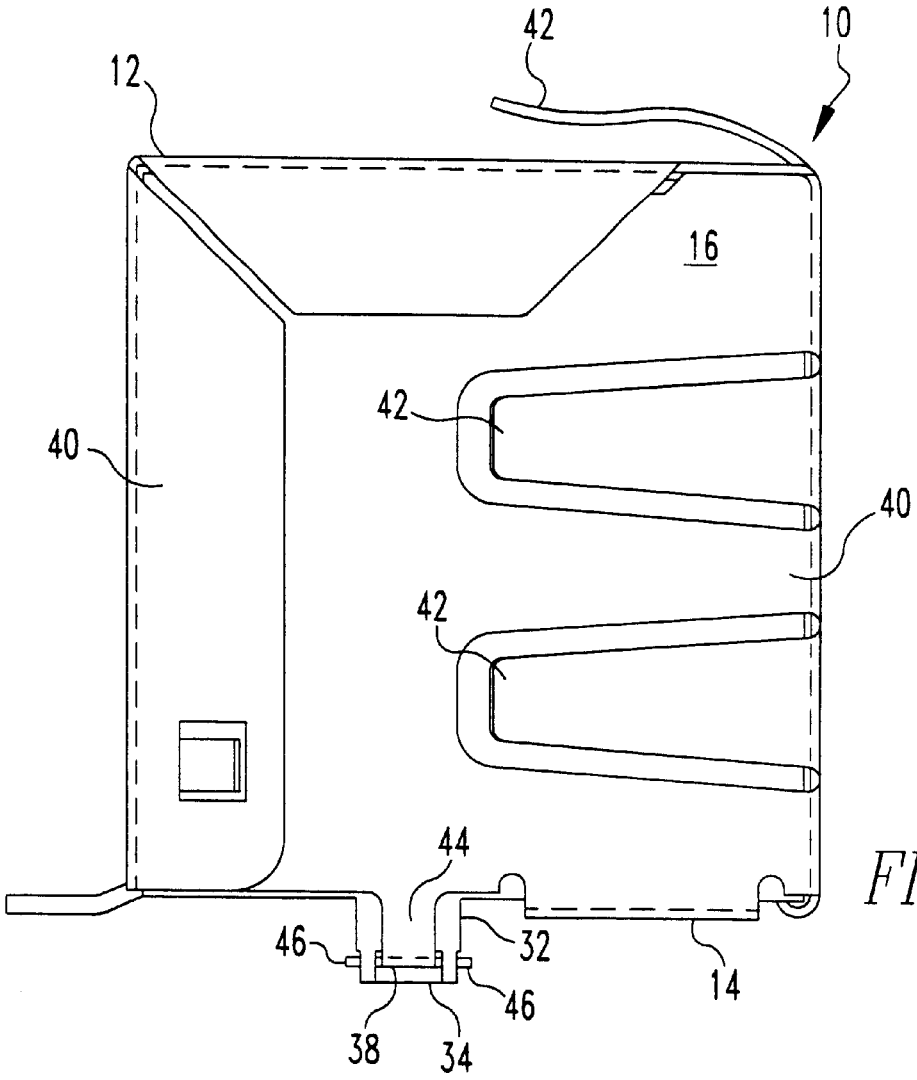
FIG. 2 is an elevational view of a side of the electrical connector of the present invention.
Figure 3:
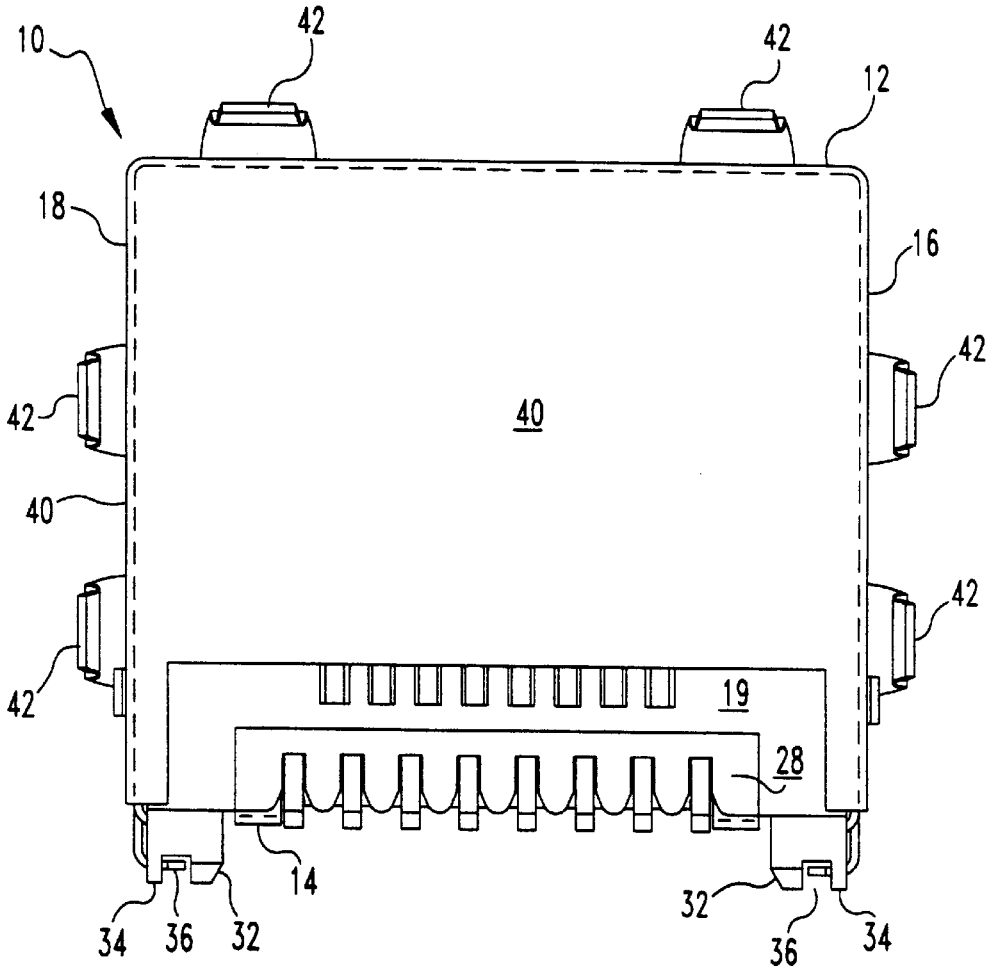
FIG. 3 is an elevational view of a rear of the electrical connector of the present invention.
Figure 4:
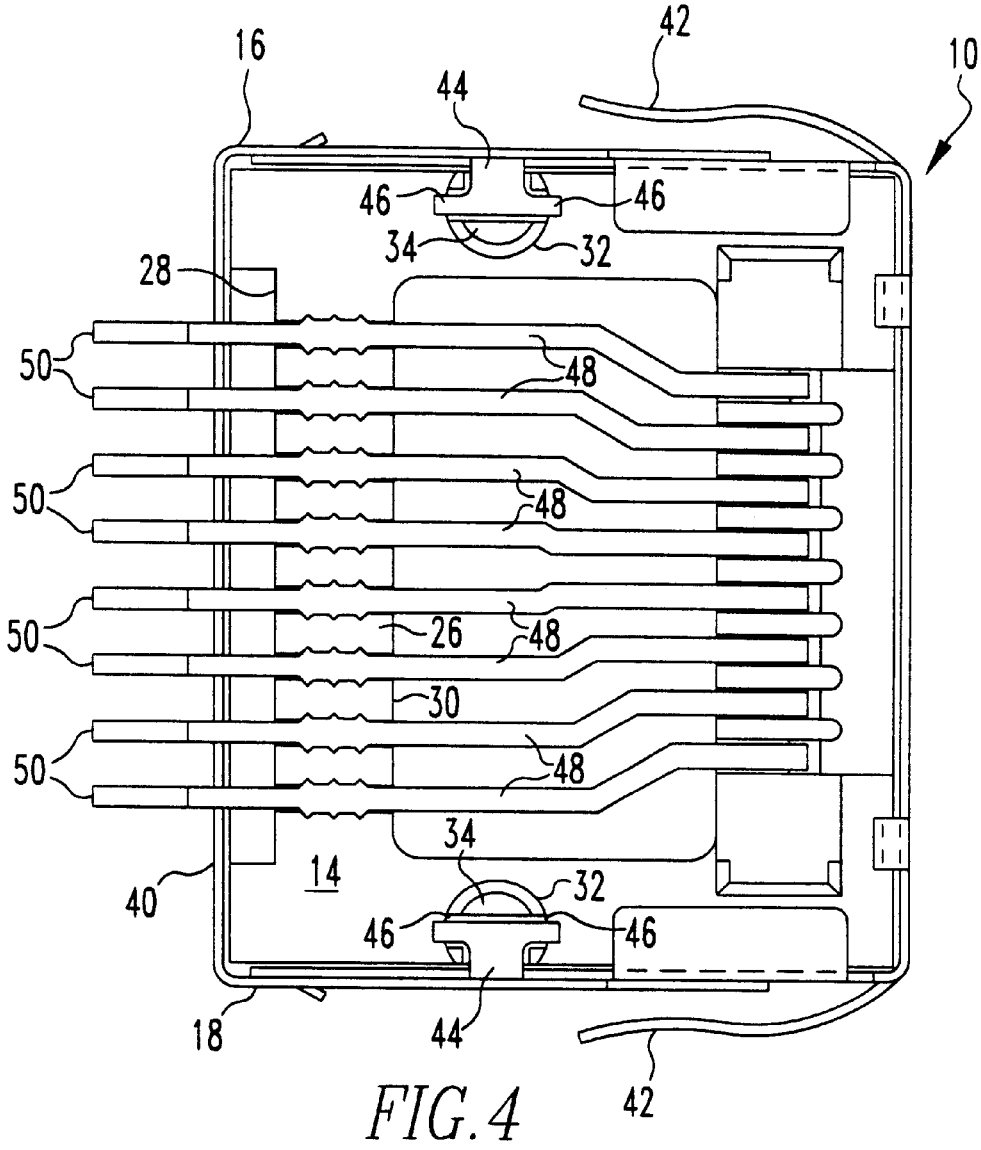
FIG. 4 is an elevational view of a bottom of the electrical connector of the present invention.

Surrounding the top wall 12, the pair of opposed lateral walls 16 and 18, and the rear wall 19 of the housing 11 is a conductive outer shielding 40. A plurality of tabs 42 project from the outer shielding 40 and extend from the front toward the rear of the connector 10. The tabs 42 are provided to contact a chassis of the electrical device (e.g., a personal computer) within which the electrical connector 10 is mounted in order to reduce electromagnetic emissions by grounding the outer shielding 40 to the chassis. As best illustrated by FIG. 4, two generally "T-shaped" sections 44 are provided at the bottom of the outer shielding 40. The "T-shaped" sections 44 are bent into the "U-shaped" opening 38 of the mounting posts 32 such that the top of the "T-shaped" section 44 is held in the groove 36 when the outer shielding 40 is secured to the housing 11. As illustrated in FIG. 2, ends 46 of the top portion of the "T-shaped" section 44 extend beyond the outer periphery of the mounting post 32.

Figure 5A:
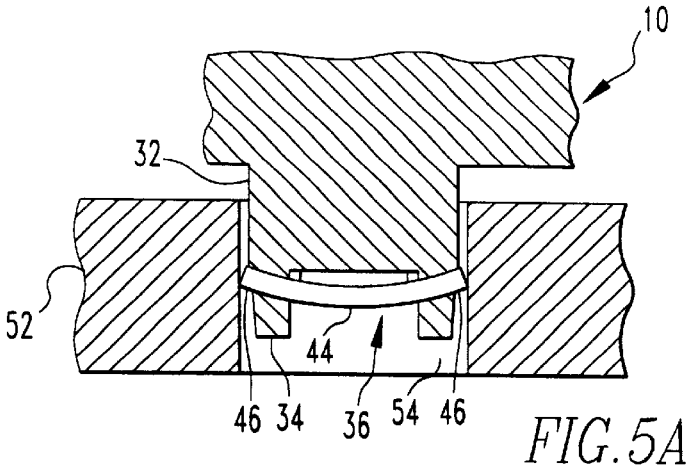
FIGS. 5A and 5B are cross-sectional views illustrating the electrical connector of the present invention mounted to a printed wiring board.
Figure 5B:
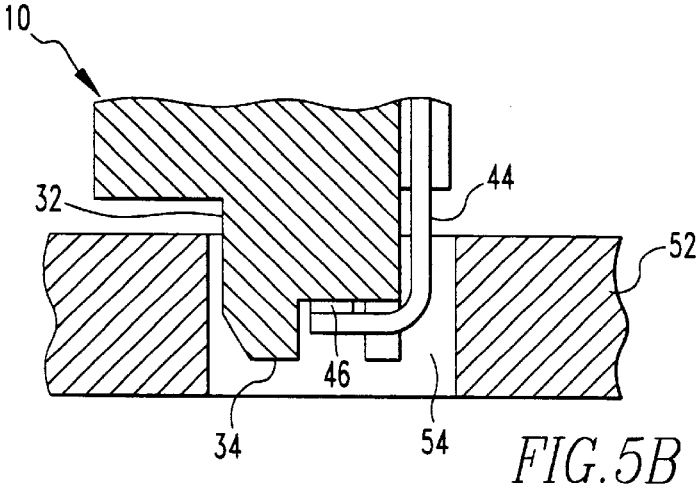
Figure 5C:
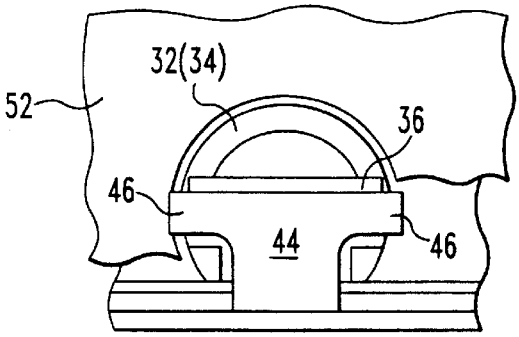
FIG. 5C is a partial elevational view illustrating the electrical connector of the present invention mounted to a printed wiring board as viewed from the underside of the printed wiring board.

As will be appreciated by those skilled in the art and will be further explained hereafter with reference to FIGS. 5A–5C, the electrical connector 10 may be mounted the printed wiring board 52 by press-fitting. The printed wiring board 52 defines a hole 54 into which the mounting post 32 is inserted. The hole 54 is larger in diameter than the mounting post 32, but smaller in diameter than the length of the top of the "T-shaped" section 44 (as defined by a length between the edges of ends 46). Further, the mounting post 32 preferably has a length that is shorter than the thickness of the printed wiring board 52, such that the mounting post 32 does not protrude beyond the underside of the board 52 when the connector 10 is mounted to the top side. In order to achieve this in a typical application where the printed wiring board has a thickness of 0.062±0.007 inches, it is preferable that the mounting posts 32 have maximum length of 0.055 inches. As shown in FIG. 5A, when the electrical connector 10 is pressed into the printed wiring board 52 for mounting, the ends 46 deflect in a direction opposite that of the direction of insertion. The biasing force created by the deflected ends 46 maintains the electrical connector 10 in the mounted position with respect to the printed wiring board 52. The biasing force is preferably large enough such that the electrical connector 10 will remain on the board 52 when the board 52 is turned upside-down, or such that the connector 10 remains on the board 52 when other components are mounted (i.e., able to withstand any shocks associated with the mounting of other components).

As can be appreciated by those of skill in the art, the present invention provides for an improved device for mounting an electrical connector to a printed wiring board. In particular, the present invention provides for a mounting apparatus that both positions and retains the connector on the board, thus eliminating the necessity of the prior art which requires separate positioning and retention mechanisms. Further, the present invention provides for high retention forces while necessitating only a relatively short hold down component.

Further, while only two mounting posts have been illustrated in the figures, it is within the scope of the present invention to provide more than two mounting posts to position and secure the electrical connector. It may be desirable to provide more than two mounting posts when the electrical connector is relatively large or heavy. In addition, while the mounting posts have been illustrated as accepting the "T-shaped" sections that are formed as part of the outer shielding, the mounting posts may be formed having a metal strip (or other semi-rigid material) embedded therein. In this alternative, the length of the embedded strip would longer than a diameter of the mounting posts in order to form the ends 46. The outer shield, thus, would not require the "T-shaped" sections.

The present invention may be employed in other specific forms without departing from the spirit or essential attributes thereof. For example, any number of materials may be used in manufacturing the disclosed latch member. While the invention has been described and illustrated with reference to specific embodiments, those skilled in the art will recognize that modification and variations may be made without departing from the principles of the invention as described herein above and set forth in the following claims.

What is claimed is:

1. An electrical connector assembly, comprising:

an insulative housing having an interior section for receiving a mating connector and a mounting post that extends from said housing;

a plurality of conductors that extend into said interior section and extend outward of said electrical connector;

an outer conductive shield covering at least a portion of said housing, and including an engaging section adapted to be received by said mounting post such that ends of said engaging section extend beyond a peripheral edge of said mounting post, said engaging section comprising a first portion that extends along the length of said mounting post and a second portion that is transverse to the length of said mounting post, said first and second portions locking said outer conductive shield to said insulative housing;

wherein said mounting post and said engaging section cooperate to align and retain said electrical connector on a printed wiring board when mounted thereto.

2. The electrical connector as recited in claim 1, wherein said mounting post defines a groove that extends across said mounting post and an opening that is formed in a side of said mounting post.

3. The electrical connector as recited in claim 2, wherein said mounting post is cylindrical and said groove extends across a diameter of said mounting post, and wherein said opening is formed along a cylindrical wall of said mounting post.

4. The electrical connector as recited in claim 2, wherein said engaging section is generally "T-shaped" and a top of the "T-shaped" section is disposed within said groove.

5. The electrical connector as recited in claim 1, wherein said outer conductive shield comprises a plurality of projecting tabs that extend from a front toward a rear of said electrical connector, and wherein said tabs are adapted to contact a chassis of an electrical device within which said electrical connector is to be mounted.

6. The electrical connector as recited in claim 1, wherein when said electrical connector is mounted to said printed wiring board, said mounting post is inserted into a complementary receiving hole defined by said printed wiring board, and said engaging section is deflected in a direction opposite of a direction of insertion to retain said connector on said printed wiring board.

7. The electrical connector as recited in claim 1, wherein said mounting posts have a length that is less than a thickness of said printed wiring board.

8. An electrical connector that includes an insulative housing, a plurality of conductors, and an outer conductive shielding that at least partially covers said housing, said electrical conductor comprising:

a plurality of engaging sections that project from said conductive shielding; and a plurality of mounting posts extending from said housing, said mounting posts defining a groove and an opening in a side of said mounting posts, wherein said engaging sections are adapted to be disposed within respective grooves of said mounting posts by passing through respective openings of said mounting posts.

9. The electrical connector as recited in claim 8, wherein said engaging sections are adapted to be retained within said grooves such that ends of each engaging section extends beyond a peripheral edge of each mounting post, and wherein said mounting posts and said engaging sections cooperate to align and retain said electrical connector on a printed wiring board when mounted thereto.

10. The electrical connector as recited in claim 9, wherein said mounting posts have a length that is less than a thickness of said printed wiring board.

11. The electrical connector as recited in claim 8, wherein said mounting posts are generally cylindrical and said grooves extend across a diameter of said mounting posts, and wherein said opening is formed along a cylindrical wall of each mounting post.

12. The electrical connector as recited in claim 11, wherein said engaging sections are generally "T-shape" and a top of each "T-shaped" engaging section is disposed within a respective groove.

13. The electrical connector as recited in claim 8, wherein said conductive shielding comprises a plurality of projecting tabs that extend from a front toward a rear of said connector, and wherein said tabs are adapted to contact a chassis of an electrical device within which said electrical connector is mounted.

14. The electrical connector as recited in claim 8, wherein when said electrical connector is mounted to said printed wiring board, said mounting posts are inserted into complementary receiving holes defined by said printed wiring board, and said engaging sections are deflected in a direction opposite of a direction of insertion to retain said connector on said printed wiring board.

15. A modular jack connector, comprising:

a housing;

generally cylindrical mounting posts formed on said housing, said mounting posts each defining a groove that extends across a diameter of the mounting post, said mounting posts further defining a generally U-shaped opening formed in a cylindrical wall, said U-shaped opening faces outwardly of said modular jack connector;

a conductive outer shielding that at least partially surrounds said housing said conductive outer shielding including generally T-shaped sections extending from a bottom of said outer shielding, wherein said "T-shaped" sections are disposed in said "U-shaped" openings of said mounting posts such that a top of said "T-shaped" sections are held in respective grooves when said conductive outer shielding is secured to said housing.

16. The modular jack connector as recited in claim 15, wherein ends of said top portion of said "T-shaped" sections extend beyond an outer periphery of said mounting posts.

17. The modular jack connector as recited in claim 16, wherein when the electrical connector is pressed fitted to a printed wiring board for mounting, said mounting posts are inserted into complementary receiving holes and said ends deflect in a direction opposite that of a direction of insertion.

18. The modular jack connector as recited in claim 17, wherein said holes are larger in diameter than said mounting post, but smaller in diameter than a length of said top of said "T-shaped" section.

19. The modular jack connector as recited in claim 17, wherein said mounting posts have a length that is shorter than the thickness of said printed wiring board.

20. An insulative housing for an electrical connector, comprising:

a medial wall defining an interior section adapted to receive a mating connector; and mounting posts extending from said housing that include grooves adapted to receive engaging sections of an outer shield, said mounting posts having a length shorter than the thickness of cooperating wiring boards, wherein said engaging sections comprising a first portion that extends along the length of said mounting posts and a second portion that is traverse to the length of said mounting posts, wherein said mounting posts and said engaging sections cooperate to align and lock said electrical connector on a printed wiring board when mounted thereto.

* * * * *